US006567054B2

(12) United States Patent
Yuanzhu

(10) Patent No.: US 6,567,054 B2
(45) Date of Patent: May 20, 2003

(54) PRIMARY RADIATOR SUITABLE FOR MINIATURIZATION

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/081,372

(22) Filed: Feb. 22, 2002

(65) Prior Publication Data

US 2002/0118139 A1 Aug. 29, 2002

(30) Foreign Application Priority Data

Feb. 26, 2001 (JP) ..... 2001-050536

(51) Int. Cl.[7] ..... H01Q 13/00
(52) U.S. Cl. ..... 343/785; 343/786
(58) Field of Search ..... 343/785, 786, 343/772, 776, 781 R, 781 P, 781 CA, 840

(56) References Cited

U.S. PATENT DOCUMENTS 6,353,417 B1 * 3/2002 Yuanzhu ..... 343/785
6,437,754 B2 * 8/2002 Yuanzhu ..... 343/786
6,469,676 B1 * 10/2002 Fehrenbach et al. ..... 343/786

FOREIGN PATENT DOCUMENTS

JP 2001-053537 2/2001 ..... H01Q/13/24
JP 2001-068922 3/2001 ..... H01Q/13/06

* cited by examiner

*Primary Examiner*—Hoang Nguyen
(74) *Attorney, Agent, or Firm*—Brinks Hofer Gilson & Lione

(57) ABSTRACT

A primary radiator includes a waveguide holding a dielectric feeder on which a radiation part, an impedance-conversion part, and a phase-conversion part are integrally formed. The radiator part widens from the aperture of the waveguide, and the phase-conversion part intersects a probe at an angle of substantially 45 degrees. Also, on the impedance-conversion part, a pair of curved surfaces are formed converging in the direction from the radiator part to the phase-conversion part, the impedance-conversion part has a cross-sectional shape which includes an approximately quadratic curve, and the thickness of the dielectric feeder converges such that the thickness gradually decreases in the direction from the radiator part to the phase-conversion part.

26 Claims, 3 Drawing Sheets

PRIMARY RADIATOR SUITABLE FOR MINIATURIZATION

BACKGROUND OF THE INVENTION

1. Field of the Invention

The present invention relates to a primary radiator which is used for a reflective antenna for satellite broadcasting, and more particularly, to a primary radiator for transmitting circularly polarized electromagnetic waves.

2. Description of the Related Art

FIGS. 6 and 7 illustrate a conventional primary radiator of this kind. FIG. 6 is a cross-sectional view of the primary radiator, and FIG. 7 is a plan view taken from the direction of the horn part of the primary radiator. As shown in these figures, the conventional primary radiator is equipped with a waveguide 10, which has a horn part 10*a* at one end, a closed surface 10*b* at the other end, and a circular shape in cross section; a pair of ridges 11 which protrude from the internal surface of this waveguide 10; and a probe 12 which is disposed between the ridges 11 and the closed surface 10*b*.

The waveguide 10 is formed by die casting using a metallic material such as zinc or aluminum, and both of the ridges 11 are formed in the waveguide as a single piece. These ridges 11 have a predetermined height, width, and length, and function as a phase-conversion part (90-degree-phase converter) which converts a circularly polarized wave entering the waveguide 10 from the horn part 10*a* to a linearly polarized wave. As shown in FIG. 7, when setting the plane including the waveguide 10 and both ridges 11 as a reference plane, the probe 12 intersects the reference plane at about 45 degrees, and the distance between the probe 12 and the closed surface 10*b* is about one quarter of the guide wavelength.

In a primary radiator having such a structure, for example, when receiving a right-handed circularly polarized wave or a left-handed circularly polarized wave which is transmitted from a satellite, the circularly polarized wave is led into the waveguide 10 from the horn part 10*a*, and is then converted to a linearly polarized wave when passing through the ridges 11 in the waveguide 10. Specifically, since a circularly polarized wave is a rotating polarized wave which is the sum of the vectors of two linearly polarized waves which have a mutual phase difference of 90°, 90-degree-phase-shifted phases are converted into the same phase and thus are converted into a linearly polarized wave by passing through the ridges 11. Thus, by combining and receiving the linearly polarized waves at the probe 12, it is possible to convert a received signal to an intermediate frequency signal with a conversion circuit, which is not shown in the figure.

However, in a conventional primary radiator having the structure described above, since the horn part 10*a* which has a desired aperture diameter and length is formed in a single piece at the end of the waveguide 10, and besides, since the ridges which have a predetermined length are formed in a single piece on the internal surface of the waveguide 10, there has been a problem in that the primary radiator becomes long in the axial direction of the waveguide 10. Also, there has been a problem in that when forming such a waveguide 10 by die casting, the ridges 11 which function as a phase-conversion part has an undercut shape, thus the molding die becomes complicated, resulting in an increased cost.

SUMMARY OF THE INVENTION

The present invention is made in view of the foregoing, and an object is to provide a primary radiator which is suitable for miniaturization at low cost.

In order to achieve the above object, in the present invention, a primary radiator includes a waveguide, a probe which protrudes from the internal surface of the waveguide towards a central axis thereof, and a dielectric feeder, which is held by the waveguide. The waveguide is closed at one end and open at the other end. The dielectric feeder includes a radiation part which widens from an aperture of the waveguide, a phase-conversion part which has a plate shape and which intersects the probe at an angle of substantially 45 degrees, and an impedance-conversion part which stands between the radiation part and the phase-conversion part which are formed integrally. The impedance-conversion part becomes narrower while arching towards the interior part of the waveguide.

In a primary radiator with this arrangement, when a circularly polarized wave enters the waveguide from the radiation part of a dielectric feeder, the circularly polarized wave is propagated from the radiation part, and through the impedance-conversion part to the phase-conversion part, converted to a linearly polarized wave at the phase-conversion part, and then combined at the probe. At that time, since the impedance-conversion part has a shape which converges and becomes narrower in the direction from the radiation part to the phase-conversion part, it is possible to drastically decrease the reflection component of the electromagnetic wave which is propagated in the dielectric feeder. Besides, even though the length of the part from the impedance-conversion part to the phase-conversion part is shortened, the phase differences for the linearly polarized becomes large, thus the total length of the primary radiator can be shortened drastically. Also, it becomes unnecessary to form integrally the horn part and the ridges (phase-conversion parts), thereby making it possible to simplify the waveguide shape, resulting in decreased cost.

In the structure described above, it is possible to realize an arch shape of the impedance-conversion part by connecting a plurality of very small inclined planes step-wise. However, it is preferable for the impedance-conversion part to have a cross-sectional shape which includes an approximately quadratic curve, and converges. With the impedance-conversion part having such a shape, it is possible to decrease reflection effectively.

Also, in the structure described above, if the phase-conversion part has an end face on the side opposing the closed surface of the waveguide, steps are formed on the end face, and the steps have two reflection surfaces which are spaced from each other by a distance of about one quarter of the guide wavelength, the phases of the electromagnetic wave which is reflected by the two reflection surface of the steps are inverted and cancelled, thus it is also possible to eliminate impedance mismatching at the end face of the phase-conversion part.

Moreover, in the structure described above, if the radiation part has a trumpet-like shape which widens from the aperture of the waveguide, and has an end face on which annular grooves having a depth of about one quarter of the electromagnetic wave are formed, the phases of the electromagnetic wave which is reflected by the end face and the annular grooves of the radiation part are inverted and cancelled, thus impedance mismatching at the end face of the radiation part is eliminated, thereby making it possible to decrease drastically the reflection component of electromagnetic waves incident on the dielectric feeder.

DESCRIPTION OF THE PREFERRED EMBODIMENT

Figure 1:
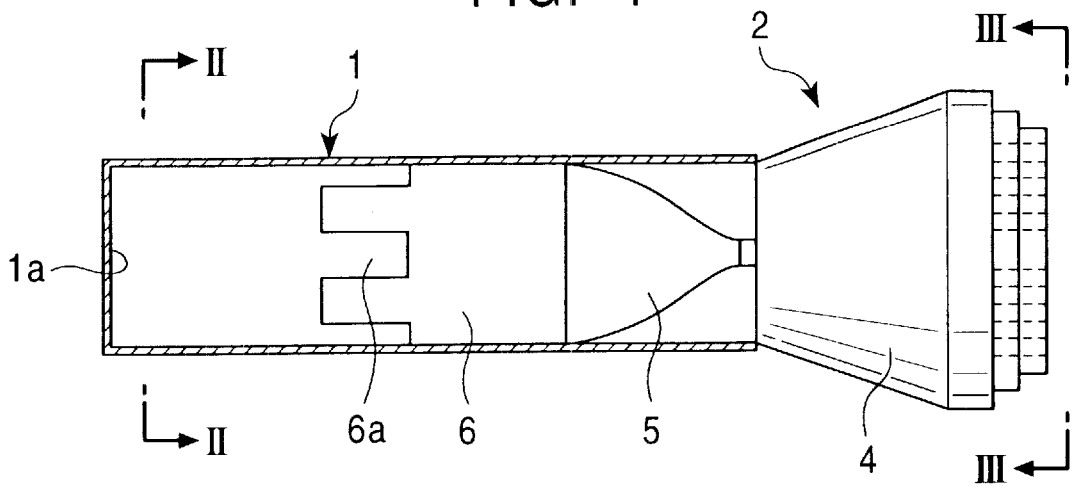
FIG. 1 illustrates the structure of a primary radiator according to an embodiment of the present invention.
Figure 2:
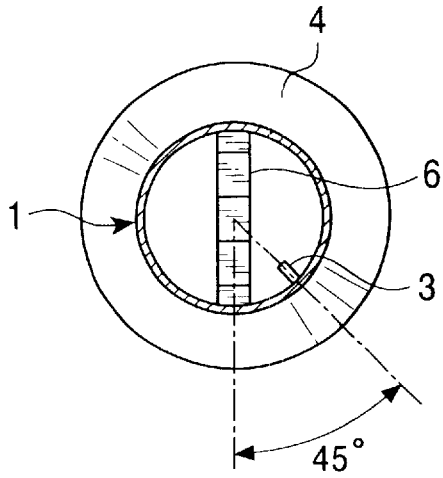
FIG. 2 is a cross-sectional view taken on line II—II of FIG. 1.
Figure 3:
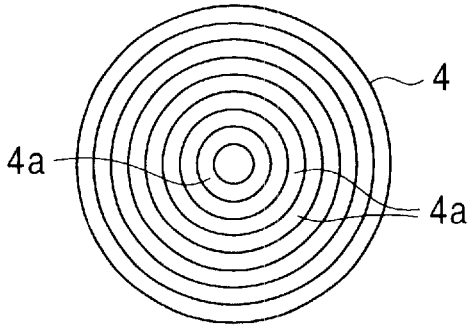
FIG. 3 is a plan view taken in the direction of line III—III of FIG. 1.
Figure 4:
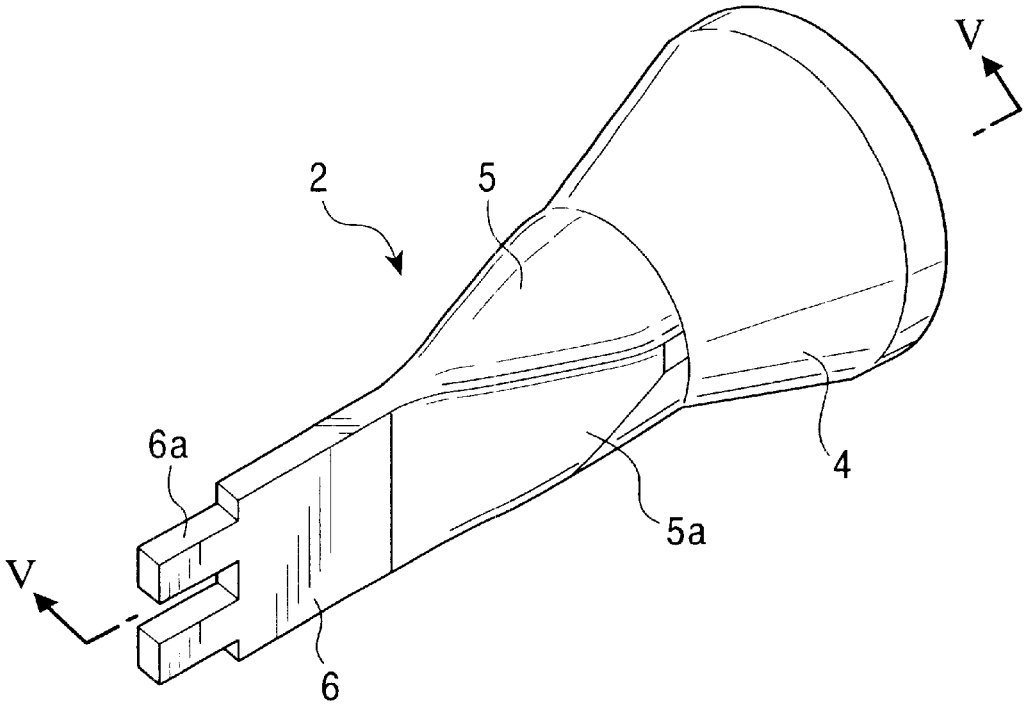
FIG. 4 is a perspective view of a dielectric feeder provided with the primary radiator.
Figure 5:
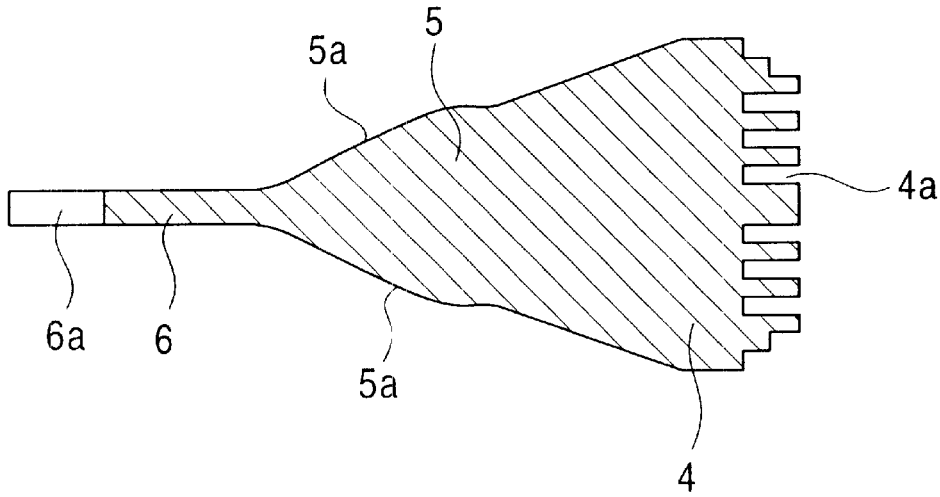
FIG. 5 is a cross-sectional view taken on line V—V of FIG. 4.
Figure 6:
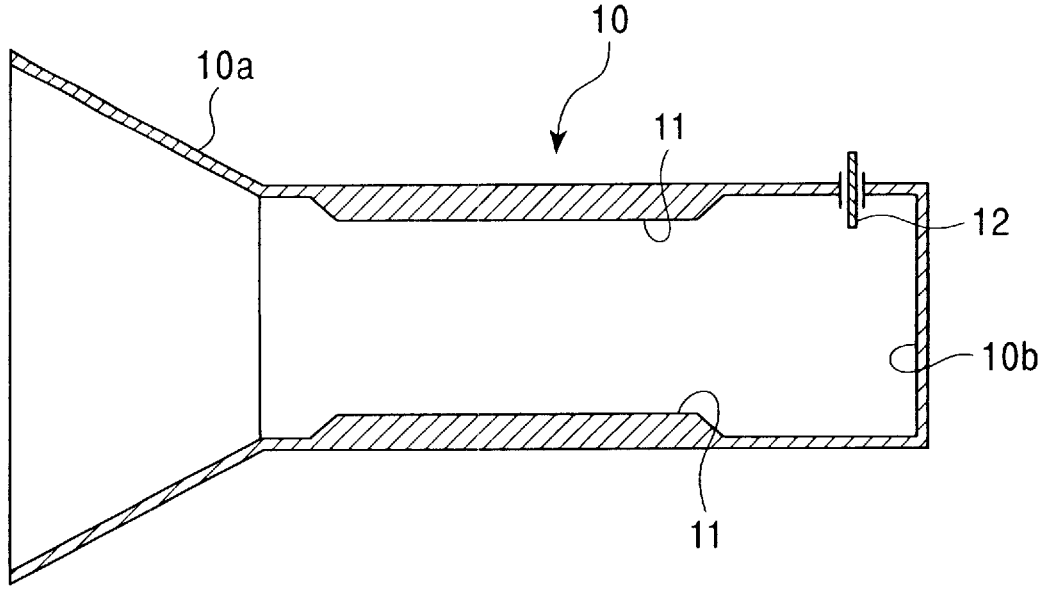
FIG. 6 PRIOR ART
FIG. 6 is a cross-sectional view of a conventional primary radiator.
Figure 7:
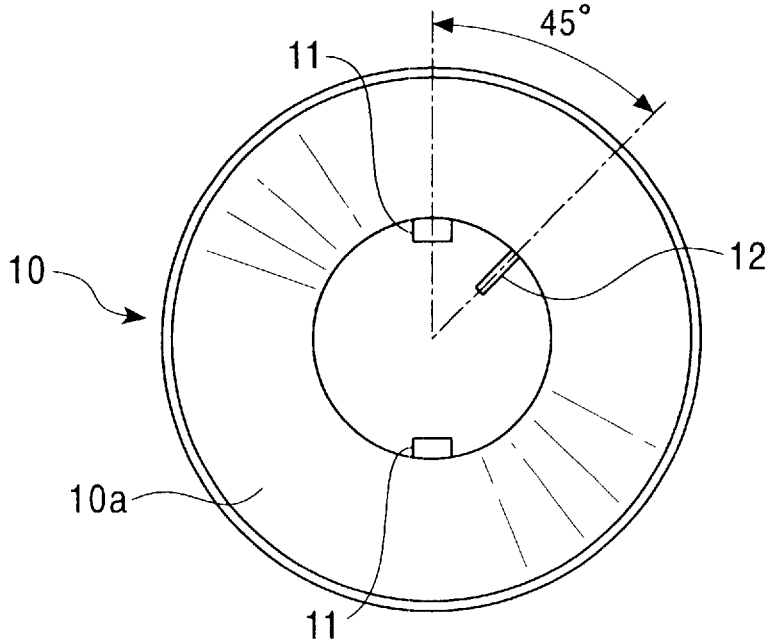
FIG. 7 PRIOR ART
FIG. 7 is a plan view of the horn part of the conventional primary radiator.

In the following, an embodiment of the present invention will be described with reference to the drawings. FIG. 1 illustrates the structure of a primary radiator according to an embodiment of the present invention. FIG. 2 is a cross-sectional view taken on line II—II of FIG. 1. FIG. 3 is a plan view taken in the direction of line III—III of FIG. 1. FIG. 4 is a perspective view of a dielectric feeder provided with the primary radiator. FIG. 5 is a cross-sectional view taken on line V—V of FIG. 4.

As shown in these figures, a primary radiator according to the embodiment of the present invention includes a waveguide 1 which has an aperture at one end and a closed face 1*a* at the other end, a dielectric feeder 2, which is held inside the aperture of the waveguide 1, and a probe 3 which is disposed on the internal surface of the waveguide 1. This probe is connected to a converter circuit, which is not shown in the figure, outside the waveguide 1. Also, although not shown in FIG. 1, the distance between the probe 3 and the closed face 1*a* is set to about one quarter of the guide wavelength $\lambda g$ (the wavelength of an electromagnetic signal in the guide).

The dielectric feeder 2 is made of dielectric material having a small dielectric tangent, and in the case of the embodiment of the present invention, low-cost polyethylene resin (dielectric constant $\epsilon \approx 2.25$) is used in consideration of the price of the material. This dielectric feeder is composed of a radiation part 4 which widens from the aperture of the waveguide 1, an impedance-conversion part 5 which is narrowed in an arch shape in the direction from the radiation part 4 towards an inner part of the waveguide 1, and a phase-conversion part 6 which extends from the narrowed part of the impedance-conversion part 5. A rear anchor part of the dielectric feeder, which is near the radiation part 4, is held inside the aperture of the waveguide 1.

The radiation part 4 has a trumpet-like (trumpet) shape which widens from the aperture of the waveguide 1, and has an end face on which a plurality of annular grooves 4*a* is formed. The depth of individual annular grooves 4*a* is set to about one quarter of the wavelength $\lambda o$ of the electromagnetic waves propagating in air (that is, $\lambda o$ is the air wavelength of electromagnetic signals that propagate in the guide), and the individual annular grooves 4*a* are formed as concentric circles (refer to FIG. 3). The impedance-conversion part 5 includes a pair of curved surfaces 5*a* which converge from a rear anchor part near the radiator part 4 towards the phase-conversion part 6, and the curved surfaces 5*a* have cross-sectional shapes which are approximately quadratic curves.

The phase-conversion part 6 is continuous with the opposing rear anchor part of the impedance-conversion part 5, which becomes gradually narrower, and is a plate-like material (i.e. opposing surfaces are substantially planar and parallel with each other) which has an almost uniform thickness. This is to say that at least one portion of the impedance-conversion part 5 tapers substantially continuously from the radiation part 4 to the phase-conversion part 6. As illustrated in FIG. 1, the impedance-conversion part 5 may be split into a first portion (curved surfaces 5*a*) and a second portion (unlabelled) that tapers from the radiation part 4 to the phase-conversion part 6 differently than the first portion. The inner surfaces of the curved surfaces 5*a* are concave (and more specifically approximately follow a quadratic curve, i.e. the cross-section is quadratic).

As shown in FIG. 2, when setting a plane which is parallel with the plate face of the phase-conversion part 6, and which includes a central axis of the waveguide 1, as a reference plane, the probe 3 intersects this reference plane at an angle of about 45 degrees, and the phase-conversion part 6 functions as a 90-degree phase converter which converts a circularly polarized wave incident on the dielectric feeder to a linearly polarized wave.

Also, on the end face of the phase-conversion part 6 which opposes the closed surface 1*a*, a plurality of cutaways 6*a* are formed, and steps are arranged by these cutaways 6*a*. The depth of the cutaways 6*a* is set to about one quarter of the guide wavelength $\lambda g$. The end face of the phase-conversion part 6 and bottom faces of the cutaways 6*a* are the two reflecting surfaces which are perpendicular to the propagating direction of the electromagnetic waves.

In a primary radiator which has such a structure, for example, when receiving a right-handed circularly polarized wave or a left-handed circularly polarized wave which is transmitted from a satellite, the circularly polarized wave is led into the inside of the dielectric feeder 2 from the radiator part 4, propagates from the radiator part 4 through the impedance-conversion part 5 to the phase-conversion part 6, is converted to a linearly polarized wave by the phase-conversion part 6, and enters the interior of the waveguide 1. Thus, by combining the linearly polarized waves which enter the waveguide 1 at the probe 3, and converting the received signal at the probe 3 to an intermediate frequency signal by a conversion circuit which is not shown in the figure, it is possible, for example, to receive circularly polarized waves which are transmitted from a satellite.

Since the plurality of annular grooves 4*a* having a depth of about one quarter of the wavelength $\lambda o$ are formed on the end face of the radiator part 4 of the dielectric feeder 2, the phases of the electromagnetic waves which are reflected by the end face of the radiation part 4 and the bottom faces of the annular grooves 4*a* become inverted and cancel each other, and thus the reflection component of an incident electromagnetic waves to the end face of the radiation part 4 can be drastically decreased. Besides, since the radiation part 4 has a trumpet shape which widens from the aperture of the waveguide 1, it is possible to converge the electromagnetic waves into the dielectric feeder 2 efficiently, and to shorten the length of the radiation part 4 in the axial direction.

Also, by forming the impedance-conversion part 5 between the radiation part 4 of the dielectric feeder 2 and the phase-conversion part 6, and connecting the curved surfaces 5*a* of the impedance-conversion part 5 having a cross-sectional shape which is approximately a quadratic curve, the thickness of the dielectric feeder converges such that the thickness gradually decreases in the direction from the radiator part 4 to the phase-conversion part 6, and thus the reflection component of electromagnetic waves which propagate inside the dielectric feeder 2 can be effectively decreased. Besides, even though the length of the part from the impedance-conversion part 5 to the phase-conversion part 6 is shortened, the phase differences for the linearly polarized waves becomes large, and thus the total length of the dielectric feeder 2 can be drastically shortened.

Furthermore, since the cutaways 6*a* having a depth of about one quarter of the guide wavelength λg are formed on the end face of the dielectric feeder 2, the phases of the electromagnetic waves reflected by the bottom face of the cutaways 6*a* and the end faces of the phase-conversion part 6 are inverted and cancelled, thus it is also possible to eliminate impedance mismatching at the end face of the phase-conversion part 6.

In this regard, a primary radiator according to the present invention is not limited to the embodiment described above, and various modifications can be applied. For example, although the total length of the dielectric feeder becomes a little longer, the radiator part may have a circular-cone shape or a pyramid shape instead of a trumpet shape. Also, the shape of the impedance-conversion part of the dielectric feeder is not limited to the embodiment described above, and, for example, it is possible to realize an approximate arch shape for the impedance-conversion part by connecting a plurality of very small inclined planes in steps which converge in the direction towards the phase-conversion part (thus the shape is still concave and, more specifically, approximately quadratic in cross-section).

In summary, in all of the above embodiments, the radiator part of the dielectric feeder and the phase-conversion part are connected with each other via the impedance-conversion part which is narrowed and which arches towards the inside of the waveguide. Furthermore, the shape of the waveguide is not limited to the embodiment described above, and, for example, it is possible to use a waveguide having a rectangular cross section instead of a circular cross section.

The present invention is achieved by the embodiment described above, and has the following effects.

On both sides of the dielectric feeder held by the waveguide, the radiator part and the phase-conversion part are formed as a single piece with the impedance-conversion part therebetween, and the impedance-conversion part is arched and is narrowed in the direction from the radiator part to the phase-conversion part; thus it is not only possible to drastically decrease the reflection component of the electromagnetic waves which are propagating in the dielectric feeder, but it is also possible to have a large phase difference for the linearly polarized wave even though the length from the impedance-conversion part to the phase-conversion part is shortened. Consequently, it is possible to shorten the total length of the primary radiator. Also, it becomes unnecessary to form a horn part and ridges (phase-conversion part) in the waveguide as a single piece (i.e. the waveguide and the dielectric are separable or separate components); thus it is possible to simplify the shape of the waveguide, which results in decreased cost.

What is claimed is:

1. A primary radiator comprising:

a waveguide having a closed end and an open end;

a probe which protrudes from an internal surface of said waveguide towards a central axis thereof; and a dielectric feeder, which is held by said waveguide, wherein said dielectric feeder includes a radiation part which widens from an aperture of said waveguide, a phase-conversion part which has a plate shape and which is disposed at an angle of substantially 45 degrees from said probe, and an impedance-conversion part which is disposed between the radiation part and the phase-conversion part, said impedance-conversion part becoming narrower while arching towards an interior part of said waveguide, said phase-conversion part, said impedance-conversion part, and said radiation part being formed integrally.

2. A primary radiator according to claim 1, wherein said impedance-conversion part converges and has a cross-sectional shape which includes an approximately quadratic curve.

3. A primary radiator according to claim 1, wherein said phase-conversion part has an end face opposing the closed surface of said waveguide, steps are formed on the end face, and the steps have two reflection surfaces which are spaced from each other by a distance of about one quarter of a guide wavelength.

4. A primary radiator according to claim 1, wherein said radiation part has a trumpet shape which widens from the aperture of said waveguide, and has an end face on which annular grooves are formed, the annular grooves having a depth of about one quarter of a wavelength of electromagnetic waves propagating in air that also propagate in the waveguide.

5. A primary radiator according to claim 1, wherein the waveguide and the dielectric feeder are separable.

6. A primary radiator according to claim 1, wherein the impedance-conversion part includes a plurality of inclined planes.

7. A primary radiator according to claim 1, wherein at least one portion of the impedance-conversion part tapers substantially continuously from the radiation part to the phase-conversion part.

8. A primary radiator according to claim 1, wherein a first portion of the impedance-conversion part tapers from the radiation part to the phase-conversion part differently than a second portion of the impedance-conversion part.

9. A primary radiator comprising:

a waveguide; and a dielectric feeder disposed in the waveguide and including: a radiation part, a phase-conversion part, and an impedance-conversion part that connects the radiation part with the phase-conversion part, the impedance-conversion part tapering from the radiation part to the phase-conversion part and having a portion with a concave inner surface.

10. A primary radiator according to claim 9, wherein a cross-section of the portion of the concave inner surface is approximately quadratic.

11. A primary radiator according to claim 9, wherein said phase-conversion part has an end face opposing a closed surface of said waveguide, steps are formed on the end face, and the steps have two reflection surfaces which are spaced from each other by a distance of about one quarter of a guide wavelength.

12. A primary radiator according to claim 9, wherein said radiation part widens from the aperture of said waveguide and has an end face on which annular grooves are formed, the annular grooves having a depth of about one quarter of a wavelength of electromagnetic waves propagating in air that also propagate in the waveguide.

13. A primary radiator according to claim 9, wherein the waveguide and the dielectric feeder are separable.

14. A primary radiator according to claim 9, wherein the concave inner surface is approximated by a plurality of inclined planes.

15. A primary radiator according to claim 9, wherein at least one portion of the impedance-conversion part tapers substantially continuously from the radiation part to the phase-conversion part.

16. A primary radiator according to claim 9, wherein a first portion of the impedance-conversion part tapers from the radiation part to the phase-conversion part differently than a second portion of the impedance-conversion part.

17. A primary radiator according to claim 9, further comprising a probe which protrudes from an internal surface of the waveguide towards a central axis thereof and is disposed at an angle of substantially 45 degrees from the phase-conversion part.

18. A primary radiator according to claim 9, wherein the phase-conversion part has opposing surfaces that are substantially flat.

19. A primary radiator according to claim 9, wherein the phase-conversion part, the impedance-conversion part, and the radiation part are integral.

20. A method of decreasing a cost of a primary radiator having a dielectric feeder with a phase-conversion part, an impedance-conversion part, and a radiation part, the method comprising:

integrally forming the phase-conversion part, the impedance-conversion part, and the radiation part; and shaping the impedance-conversion part to taper and arch from the radiation part to the phase-conversion part.

21. The method of claim 20, further comprising forming the dielectric feeder separately from a waveguide of the primary radiator.

22. The method of claim 20, further comprising angling the phase-conversion part at an angle of substantially 45 degrees from a probe protruding from an internal surface of a waveguide of the primary radiator.

23. The method of claim 20, further comprising shaping the impedance-conversion part to have a cross-section that includes an approximately quadratic curve.

24. The method of claim 20, further comprising shaping a curve of the impedance-conversion part approximately using a plurality of inclined planes.

25. The method of claim 20, further comprising forming steps of about one quarter of a guide wavelength on an end face of the phase-conversion part.

26. The method of claim 20, further comprising forming annular grooves on an end face of the radiation part of a depth of about one quarter of a wavelength of electromagnetic waves propagating in air that also propagate in a waveguide of the primary radiator.

* * * * *